United States Patent [19]

Forrest

[11] 4,087,089

[45] May 2, 1978

[54] FOOTBALL LINEMAN TRAINER

[76] Inventor: Charles Phelps Forrest, 1306 St. Stephens Rd., Mobile, Ala. 36603

[21] Appl. No.: 687,743

[22] Filed: May 18, 1976

[51] Int. Cl.[2] ..... A63B 67/00

[52] U.S. Cl. ..... 273/55 R

[58] Field of Search ..... 273/55 R, 55 A

[56] References Cited

U.S. PATENT DOCUMENTS

| | | | |
|---|---|---|---|
| 2,162,073 | 6/1939 | Evans | 273/55 R |
| 2,558,081 | 6/1951 | Gardenhour | 273/55 R |
| 3,044,776 | 7/1962 | Weldmaier et al. | 273/55 R |
| 3,425,692 | 2/1969 | Leach | 273/55 R |
| 3,684,283 | 8/1972 | Forrest | 273/55 R |
| 3,889,949 | 6/1975 | Gardner | 273/55 R |

*Primary Examiner*—Richard C. Pinkham
*Assistant Examiner*—T. Brown
*Attorney, Agent, or Firm*—Cameron, Kerkam, Sutton, Stowell & Stowell

[57] ABSTRACT

A football lineman trainer has a frame supported on runners between which rollers are positioned for control through foot pedals by an operator on the frame to vary the resistance to movement of the trainer as linemen contact individual pad units which can be set and locked in low, high and intermediate positions or can be moved from and into such positions by the operator through a foot pedal assembly so as to teach different techniques for both defensive and offensive linemen with the pad units being separately adjustable from straight up to approximately 30° leaning positions with such positions being sustained at the various low or high placements and movements of the pad units which are designed for face blocking as well as shoulder blocking.

14 Claims, 8 Drawing Figures

FOOTBALL LINEMAN TRAINER

BACKGROUND OF THE INVENTION

1. Field of the Invention:

The present invention generally appertains to improvements in football practice apparatus. In particular, this invention relates to a novel and improved device for training linemen in different techniques used for defensive and offensive play.

2. Description of the Prior Art:

Training sleds are known in the prior art. Examples of such are disclosed in U.S. Pat. No. 2,653,816 issued on Sept. 19, 1953 to Young et al and U.S. Pat. No. 3,684,283 issued on Aug. 15, 1972 to Forrest.

The apparatus of U.S. Pat. No. 2,653,816 is a charging sled of the seven man type. Such sled relies solely upon its frictional engagement with the ground to resist the pushing or charging action of the seven linemen. The entire line moves as a unit to push the sled which may be too heavy or light for teams of varying grades such as professional, college and high school. Such single weight sled can be made heavier by using sand bags as added weight. But is cannot be made lighter. Nor can such sled simulate the actions of opposing defensive or offensive lineman so that it cannot simulate the body contact that occurs under actual playing conditions.

The sled of U.S. Pat. No. 3,684,283 overcame one of the problems attendant with the typical seven man sled of U.S. Pat. No. 2,653,816 in that it provides rollers between the runners or skids with the rollers being movable up and down by foot pedals actuated by an operator on the frame. By means of the foot pedals the rollers can be moved relative to the ground so as to vary the resistance of the runners with the ground. Thus, the ease with which the sled can be moved by the linemen can be varied. This makes the sled a multiple weight one. In addition, the placement of the rollers on opposing sides of the center line of the sled and provision of separate pedals for the rollers permits the operator to control the resistance to movement of the sled on each side of the line.

However, such improved sled does not have blocking pads that are constructed to simulate the actions of opposing players under game conditions. Thus, while the sled can give the coach a view of the actions of linemen, as a group, on one side or both sides of the sled, it cannot give the coach any impression regarding each lineman and his individual performance.

Accordingly, there is a need for a trainer, such as the football sled, whereby each lineman can be examined in his movements, either defensive or offensive techniques, by a coach to ascertain if the player is performing correctly. And if he is not, to enable the coach to teach the different techniques under conditions as near to actual playing conditions as possible.

SUMMARY OF THE INVENTION

The lineman trainer of the present invention possesses in an improved way the roller arrangement of the earlier U.S. Pat. No. 3,684,283 while providing means to overcome the problem attendant with game simulation aspects thereof and providing means whereby each player on the line can be observed and taught.

The trainer of this invention is unique in the fact that each pad on the sled is an individual unit that each player can hit at the low position and drive upward to the high position. This makes every player on his own as he would be on a line of scrimmage under playing conditions. If one player does not do his job correctly, the coach will know it immediately. In addition, each pad unit has a shaft behind the pad to add additional weight so that each unit can be modified to conform to a player.

Further, the trainer has varied height settings that are useful in teaching different techniques for defensive and offensive linemen. For example, the pad units can be set in the low position for defensive lineman and locked in this position so a lineman will stay low and drive his opponent back the way most coaches teach defensive line blocking today. In the down position for defense, the trainer has an actuating bar for the pad units with a control rod for the bars running underneath the pad brackets. The coach while standing on the sled can push a foot pedal means next to the roller pedals to rotate the rod and move the actuating bars so as to make the pad units move as offensive linemen would. This teaches defensive linemen to fire out on the slightest movement of offensive linemen. When the pad units are not locked in the down position, the actuating rod can be actuated to raise the pad units to the high position. When in the high position, the coach can release the pedal means and permit the pad units to fall suddenly as linemen would move in actual play. This will teach the practicing players to react quickly.

The angle of the mounting bracket for the pad of each pad unit is also adjustable so that each pad can be adjusted from a straight up position to one approximately 30° lean. This will permit each pad to lean out from a straight up and down position. Also, the pad on each unit can be adjusted vertically for height.

Each pad unit can be activated up or down by the player on contact. Also, each pad unit has three adjustments, namely, low position, intermediate position, and high position. The low position is usually used for defensive players in order to keep them low when firing out. The intermediate position is used for offense, as the offensive player usually fires out higher than the defensive player. The high position is for defensive tackling. The pad units may be locked in place in each position for the pad units may be allowed to travel from the different settings in which the coach may place them.

The special features on this trainer makes it an all purpose piece of equipment, offensive and defensive.

Thus, it can be appreciated that an important object of the present invention is to provide an improved roller arrangement for a training sled with ground engaging runners and to equip such sled with individual pad units that are adjustable from low through intermediate to high positions and lockable in such positions or moved by an operator on the sled from and into such positions.

Another important object of the present invention is to provide a trainer that is designed for teaching and inspecting on an individual basis the offensive and defensive techniques of one or more linemen.

A further important object of the present invention is to provide a trainer that can be made in multiples from a one man station to seven men stations with each station having a pad unit forward of a ground engaging runner.

Another important object of the present invention is to provide an improved, safe and practical pad unit which is designed for adjustable attachment to a training sled and is especially designed so that it may be face blocked as well as shoulder blocked.

DESCRIPTION OF THE PREFERRED EMBODIMENT

Figure 1:
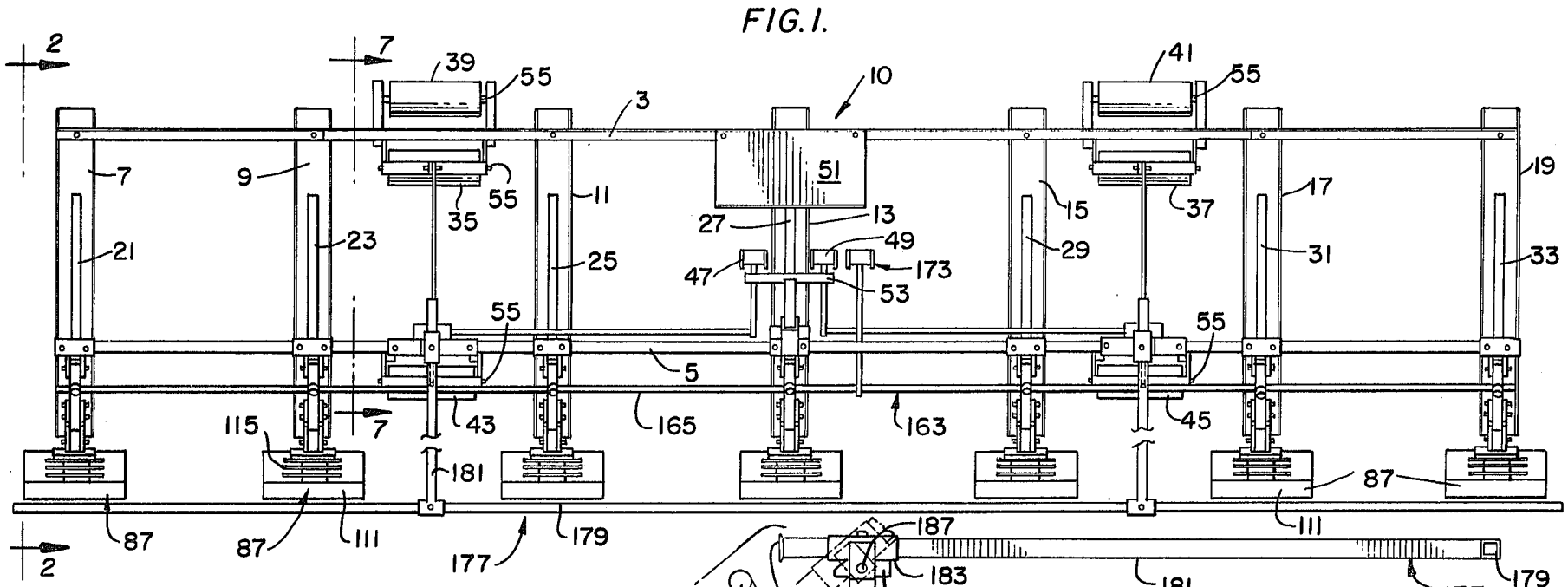
FIG. 1 is a top plan view of the football lineman trainer of the present invention.

Referring to the drawings, reference numeral 10 represents generally the trainer of the present invention including a frame comprising a lower rear horizontal angular frame member 3 and a front horizontal main frame member 5. Frame member 5 is elevated from underlying skids or runners 7, 9, 11, 13, 15, 17 and 19 by vertical T-shaped support members 20 and is rigidly connected by diagonally placed channel framing pieces 21, 23, 25, 27, 29, 31 and 33 to the runners. The frame member 3 is fastened to the runners by suitable bolt assemblies or other fastening means, for example, welding. And such fastening means connects the various support members and framing pieces to the various frame sections and the runners.

As shown in FIG. 1, the trainer is a seven man one and, as such, is symmetrical about its center line and includes the seven runners 7, 9, 11, 13, 15, 17 and 19, each having a wide flat surface adapted to engage the ground. Between runners 9, 11 and 15, 17 are mounted a rear pair of rollers 35, 39 and 37, 41 respectively, and front rollers 43 and 45 respectively. Rollers 35, 43 and 37, 45 are operatively connected to foot pedals 47 and 49 respectively, located at a supporting platform 51 for a coach. Platform 51 is secured to the rear frame member 3 and centermost channel framing piece 27. Disposed above and to the front of platform 51 is an operator's rest or stabilizing handle 53.

Each of rollers 35, 37, 43 and 45 is fixedly supported to an axle bar 55 journalled in axle support member 57. Each axle support 57 is pivotally attached at 59. Each axle support 57 has connected thereto a vertical lift member 61 which is in turn connected to link members.

Figure 7:
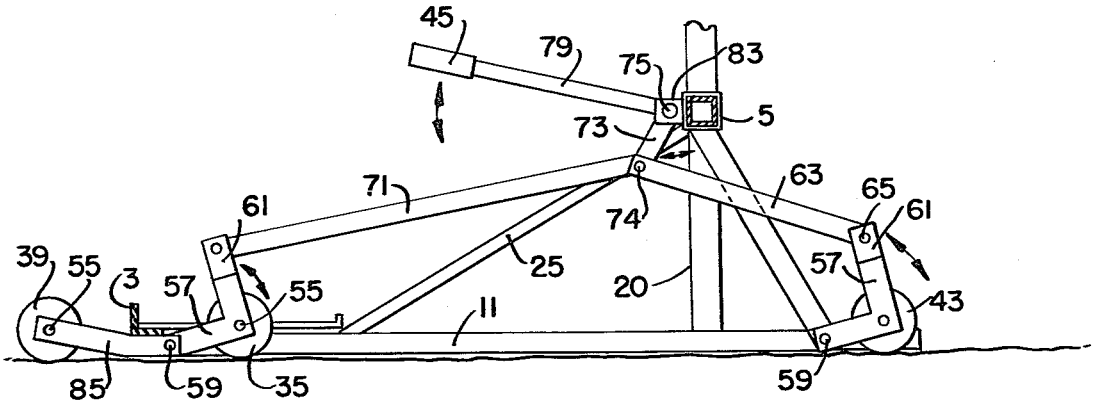
FIG. 7 is a vertical cross-sectional view taken along line 7—7 of FIG. 1.

As best seen in FIG. 7, front axle supports 57 are connected via lift bar 61 to link member 63 via pin member 65. Rear axle supports 57 are also connected through vertical lift member 61 to one end of the bar 71. Bar 71 is coupled to a vertical bar 73 to which link member 63 is also coupled as at 74. The coupled ends of bars 63 and 71 are connected by bar 73 to one end of roller lift rods 75 or 77, which have their other ends integral with or rigidly connected to foot pedal rods 79 and 81. Pedals 47 and 49 are secured to the ends of rods 79 and 81 and suitable brackets 82 welded to the frame member 5 support the lifting mechanism. The rearward most rollers 39 and 41 are supported by brackets 85.

Each pedal operates independently of the other. Depression of pedal 47 by a coach on the platform 51 controls the left side set of rollers 35, 43 and causes lift bar 75 to rotate about its longitudinal axis. Rotation of bar 75, in turn, causes the lower end of bar 73 to swing forward in an arc. Links 63 and 71, which are coupled thereto, are thus also swung forward carrying their respective rollers forward and upward. A similar action results with rollers 37 and 45 on the right side of the training sled, as viewed in FIG. 1, upon depression of pedal 49 by the coach. It should be apparent that by controlling the extent of depression of the foot pedals, the extent of functional engagement of the runners with the ground may be regulated. In normal position, the rollers are in contact with the ground and the channel runners are spaced slightly above ground. This enables the lineman trainer 10 to be pushed about with relative ease. If desired, the lineman trainer 10 could be arranged with the channel runners normally resting on the ground and the rollers adapted to be controlled so as to raise the device and thus control the effective resistance to movement.

As hereinbefore described, each foot pedal controls the roller sets on each side of the lineman trainer 10 independently of the other sets. This enables the coach to control the resistance to movement of the lineman trainer on each side of the center line. This is advantageous for training purposes and enables simulation of weak left side or weak right side conditions. It also enables the application of heavier training methods where it might be expected that linemen on one side or both sides are not giving their best effort. The rearwardmost rollers 39 and 41 are advantageous when the attacking linemen raise the front of the trainer too high. In the event this happens, the device will roll rather than dig into the ground.

The lineman trainer 10 in its full extent is a seven man trainer, as shown in FIG. 1. Thus, it has seven runners and in front of each runner is a pad unit 87. Of course, the trainer can be changed into multiples of 2, 3, 4, 5, 6 or 7 stations. And it can consist of one station. Normally, the seven man trainer of FIG. 1 would be converted into a five man unit and a two man unit by removing the end sections of the trainer 10 of FIG. 1. This would leave a five man unit. And the removed end sections would be joined together to establish a two man trainer.

The rollers are very wide, as can be appreciated from a consideration of FIG. 1. And this extensive width will avoid a situation where the runners would dig into the ground. Assisting in this is the fact that the runners are also made of a width wider than the width of the runners disclosed in U.S. Pat. No. 2,653,816.

The presence of the rearmost rollers 39 and 41 will serve to prevent the rear ends of the runners from digging into the ground when the charging linemen may tend to raise the front of the trainer and the front ends of the runners off the ground. In this respect, the wide rollers 39 and 41 are placed so that they are located rearwardly of the back ends of the runners, as is shown in FIG. 1.

Each pad unit 87 is mounted on the frame forwardly of one of the runners on the frame, as shown in FIG. 1. Each pad unit 87 is constructed and mounted in the same manner and is adapted to be contacted by a lineman while also being movable into various height settings by the coach from the platform 49.

Figure 8:
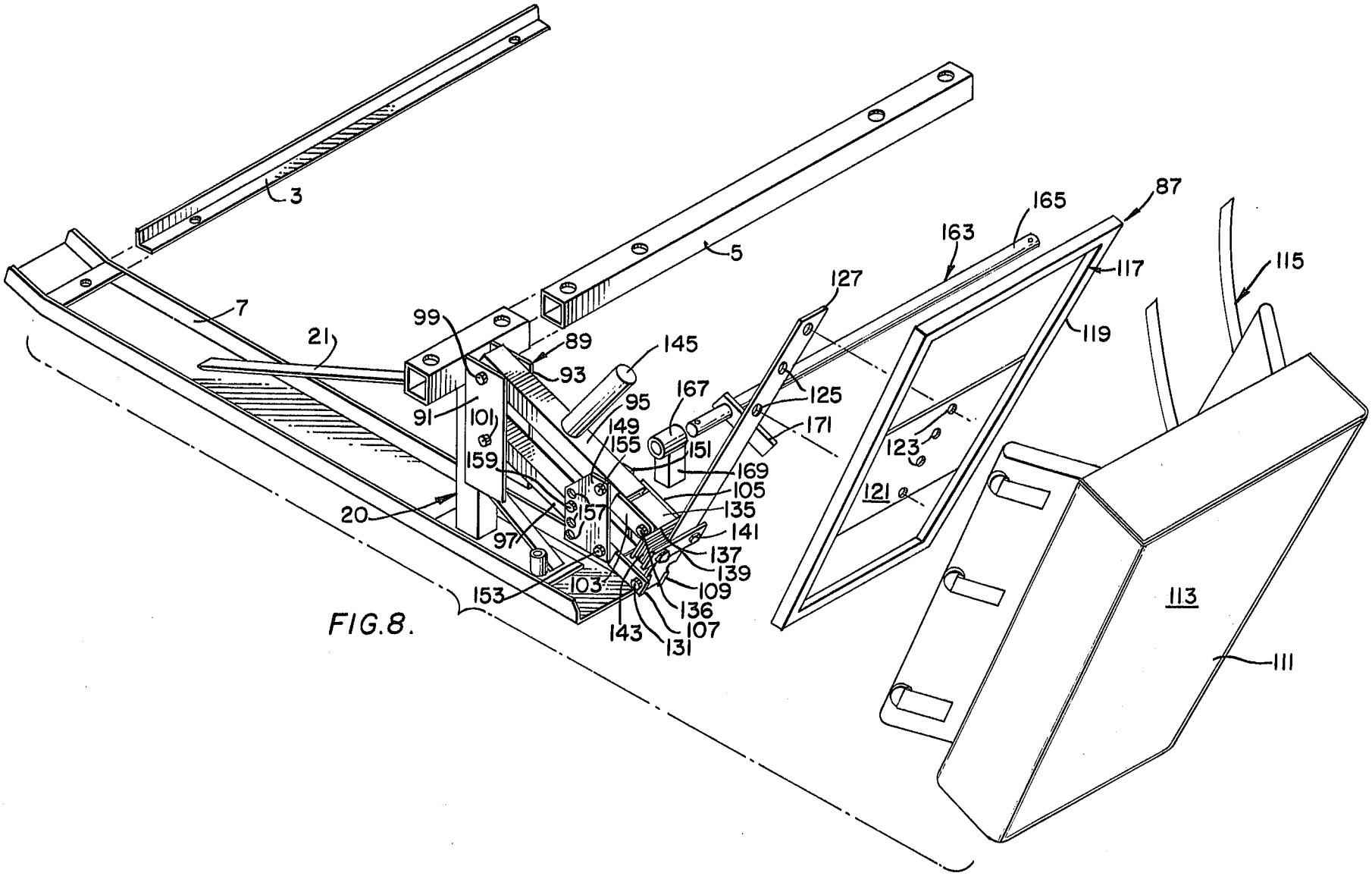
FIG. 8 is an exploded perspective view of the pad unit at the left end of the trainer of the present invention.

Each pad unit, as shown more particularly in FIGS. 3–6 and 8, comprises a frame support means 89 which is composed of spaced apart vertical plates 91 and 93 that are mounted on the vertical leg portion of each T-shaped support 20, as shown specifically in FIG. 8. The plates 91 and 93 are horizontally spaced apart a sufficient distance to receive the inner ends of upper and lower channel arms 95 and 97 which are positioned between the mounting plates and pivotally attached thereto by horizontal pivot pin assemblies 99 and 101. Thus the arms, which constitute an arm supporting means for the pad unit 87, are disposed in vertically spaced, parallel relationship, for vertical swinging movement in a curvilinear path about the pivot points 99 and 101 on the frame.

The outer end of the upper arm 95 is bifurcated so as to be provided with parallel branches or legs 103 and 105. Similarly, the outer end of the lower arm 97 is bifurcated so as to be provided with parallel bifurcations or legs 107 and 109.

Each of the pad units 87 is further composed of a substantially rectangular cushioned pad 111 which has a substantially flat and relatively large outer face 113 that is adapted to be contacted by the face or shoulder of the lineman engaged in practice. The cushioned pad 111 is provided on its rearside with a strap assembly 115 by means of which it is securely superimposed on the front of a pad bracket 117 that is in the form of a rectangular frame 119 having a cross plate 121 fixed between the vertical sides thereof. The pad bracket 117 supports the pad 111 with the straps 115 encircling the pad bracket and securing the pad over the front of the pad bracket, as can be appreciated from a consideration of FIG. 8.

The cross plate 121 of the pad bracket is provided with a vertical set of apertures 123 that are adapted to be aligned with vertically spaced apertures 125 formed in the upper end portion of a spring bar 127. The aligned apertures 123 and 125 are adapted to receive bolt assemblies whereby the pad 111 can be attached to the spring bar 127 in a vertically adjustable fashion so as to be positioned at various heights on the spring bar 127 and relative to the frame.

Figure 6:
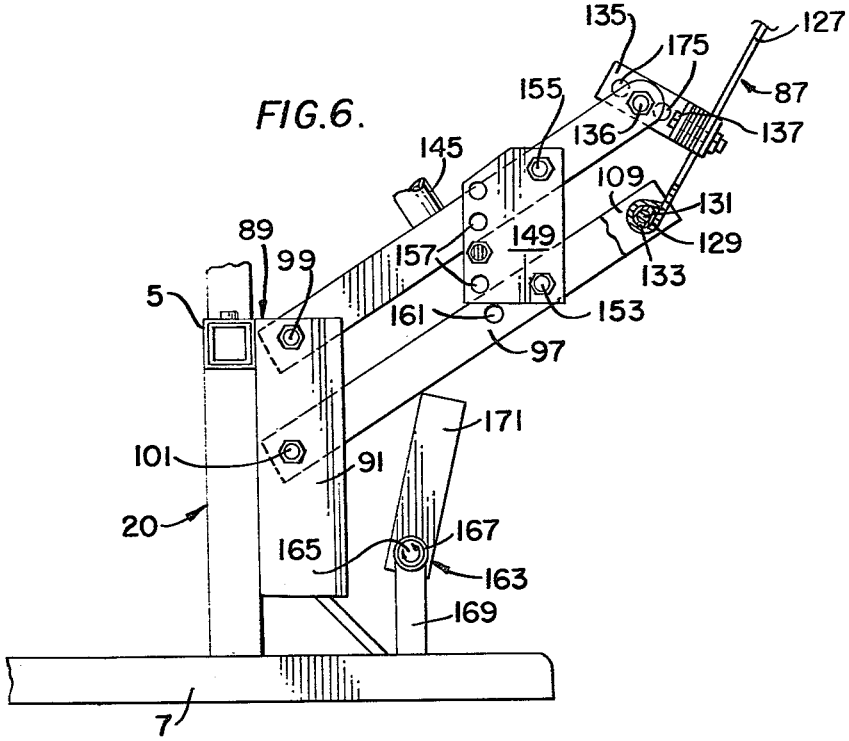
FIG. 6 is a side-elevational view of one of the pad units shown in the raised position.

As shown more particularly in FIG. 6, the spring bar 127 is formed at its lower end with a curled portion 129 that constitutes a mounting eye to receive a pivot pin 131 that extends between the outer legs 107 and 109 of the lower arm 97 and is positioned within a suitable bushing 133. In such manner, the spring bar 127 is pivoted to the arm supporting means. The outer end of the upper arm 95 is adapted to receive between its branches or legs 103 and 105 the leg portion 135 of a T-member, which is attached thereto by a bolt means 136. A cross plate 137 is formed on the outer end of the leg 135 and complements a plate 139 which is affixed thereto by bolt assemblies 141. The plates 137 and 139 are bolted on opposite faces of the lower end portion of the spring bar 127 above its bottom pivot point and attach the spring bar to the upper arm 95 with a resilient bumper member 143 being interposed between the inner face of the spring bar and the outer face of the plate 137. Thus, when the pad 111 is contacted by a player, engaged in a blocking or tackling assignment, the spring bar 127 adds resiliency to the pad and absorbs the shock of the player's physical contact, while it moves about its bottom pivot point 131 and, at the same time, bears against the shock absorbing bumper 143, as can be appreciated from a consideration of FIG. 4.

Figure 3:
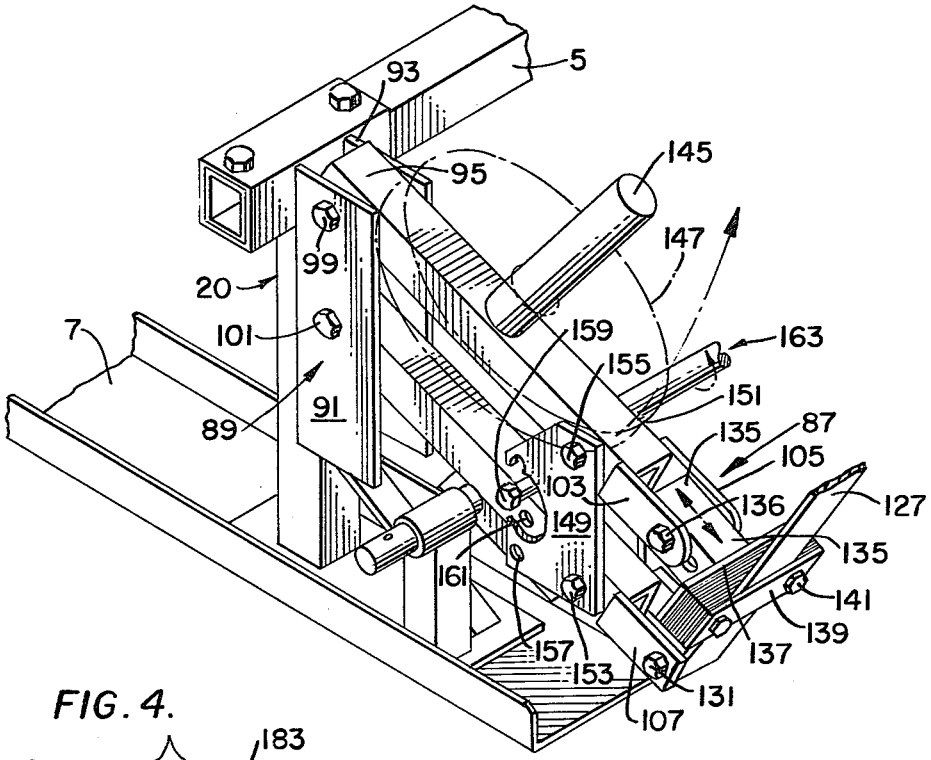
FIG. 3 is a fragmentary perspective view of one of the pad units for the trainer.

The upper arm 95 of each pad unit 87 is provided intermediate its ends with an upstanding rod 145 on which apertured disc-like weights 147, as shown in FIG. 3, can be positioned so as to add additional weight to the arm supporting means for any desired pad unit 87, thereby increasing the amount of physical force required to move the arm supporting means upwardly about the pivot points 99 and 101 or to prevent it from falling down about such pivot points.

In the latter respect, the arms 95 and 97 are coupled together by side plates 149 and 151. The coupling side plates 149 and 151 are provided with transverse openings that are adapted to be aligned with transverse apertures in the upper and lower arms so as to receive bolt assemblies 153 and 155. In such manner, the plates are attached together and couple the arms together for common swinging movement about the pivot points 99 and 101 on the frame supports. The plates 149 and 151 control the range of movement of the arms by virtue of a series of vertically spaced adjustment holes 157 provided transversely in the rearward portions of the plates with an adjustment or stop bolt 159 being selectively positionable through an aligned pair of such holes. Thus, if a lower range of movement of the arms is desired, the adjustment or stop bolt 159 would be placed through the uppermost adjustment holes in the series while if the higher range of movement would be desired, the adjustment bolt 159 would be placed through the lowermost aligned holes in the plates. Intermediate positions would be controlled by positioning the stop or adjustment bolt 159 in aligned holes 157 intermediate the top holes in both plates and the lower holes in both plates.

Each pad unit 87 may be locked in a selected position by aligning one of the upper or lower adjustment holes or those vertically intermediate therebetween with a hole 161 transversely formed in the lower arm 97, as shown in FIG. 3. When the bolt 159 is placed through the selected aligned holes in the plates 149 and 151 and through the hole 161 in the lower arm 97, the arms 95 and 97 cannot move about their pivot points 99 and 101 and, therefore, are locked against swinging movement.

Figure 4:
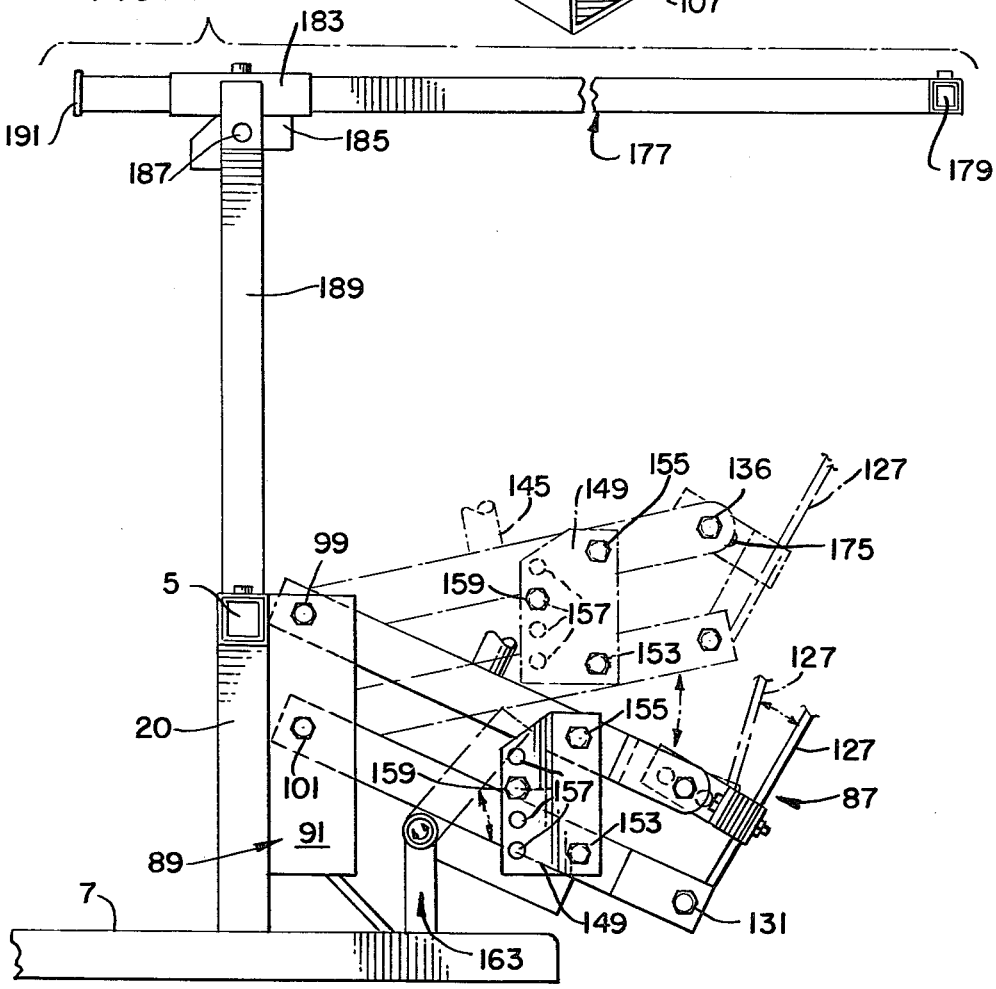
FIG. 4 is a side elevational view of one of the pad units shown in full lines in its lowered position and shown in phantom lines in its upward position.
Figure 5:
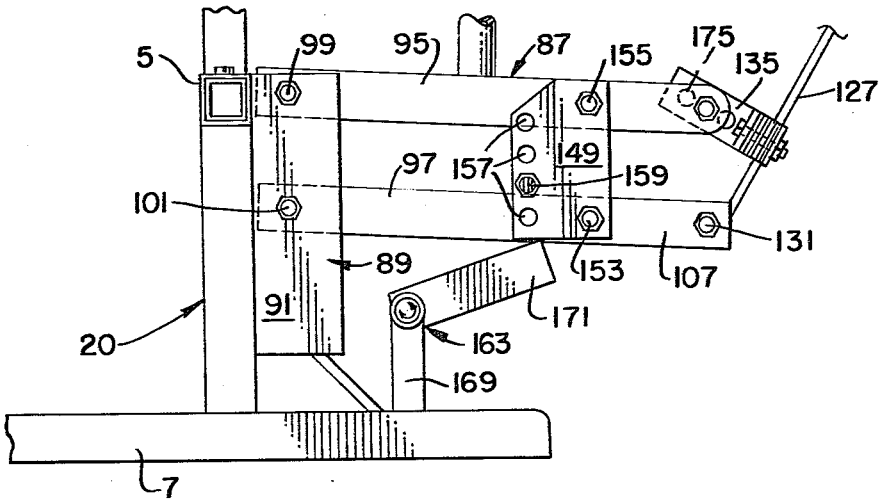
FIG. 5 is a side elevational view of one of the pad units shown in a position intermediate its loweed and upward positions.

When the arms are free to move, in the manner shown in FIGS. 4 through 6, the position of the pad units 87 can be selected and controlled by a coach from the operator's platform 51 through an actuating means 163. Such actuating means, as shown in FIGS. 1 and 8, includes an elongated rod 165 which extends lengthwise of the frame and is positioned on the frame for rotational movement by virtue of tubular journals or sleeves 167 that are mounted on the upper ends of vertical support members 169 attached to the frame. The rod 165 carries actuating arms 171 that radially extend therefrom in back of each pad unit 87 and are adapted to strike against and engage the cross plates 123 of each pad bracket. The rotation of the rod 165 so as to occasion the striking force of the actuating arms 171 against the pad brackets 117 is effected by depression of a foot pedal means 173 located adjacent to the pedals 49 and 49 for the rollers and in a position for easy contact by a coach standing on the platform 51.

By virtue of the actuating means, the pad units 87 can be moved to simulate the movements of offensive linemen. The actuating rod 165 and its associated arms 171 can cause the pad units 87 to move to a high position from a low position and, when in the high position, the coach can remove pressure from the foot pedal means 173 and permit the pad units to fall suddenly. Thus, it can be appreciated that the coach or other operator from the platform 51 can by means of the foot pedals 47 and 49 control the roller assemblies and vary the degree of ground engagement of the runners with the ground while, at the same time, by virtue of the foot pedal means 173, control the different height settings for the pad units 87.

Figure 2:
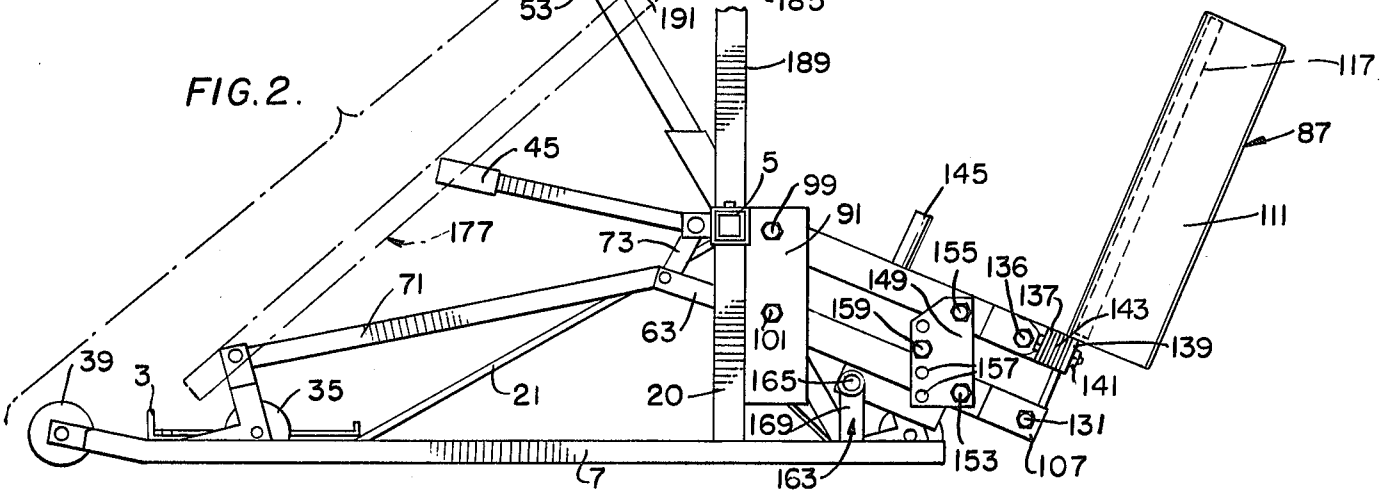
FIG. 2 is a side elevational view thereof and is taken along line 2—2 of FIG. 1.

The height settings are most useful in teaching the different techniques required for proper play by defensive and offensive linemen. For example, the pad units 87 can be set in the lowest position, as shown in FIG. 2, for defensive linemen and can be locked in such position by virtue of the positioning of the placement of the bolt 153 in the locking hole 161 in the lower arm 97. When the pad units are locked in such position, linemen can be taught to stay low and drive their opponents back the proper way that defensive line blocking should be executed. With the arms free to move and the arms in the down position for defense, the coach while standing on the platform 51 can depress the foot pedal means 173 and make each pad unit move up in the manner an offensive lineman would. This would teach players to fire out on the slightest movement of offensive linemen so that they would be taught proper defense techniques. The coach can raise the pad units 87 to the high position and, when the units are in such high position, the coach can release pressure on the foot pedal means 173 and allow the pad units 87 to fall suddenly as a lineman would be prone to so as to teach the players to react quickly to the movements of the opposing linemen.

The pads 111 can be adjusted from a straight up and down position relative to the support arms 95 and 97 into an extreme inclined position of approximately 30° relative to such arms by virtue of the provision in the leg portion 135 of the plate 137 of a lengthwise spaced series of transverse holes 175, as shown particularly in FIGS. 5 and 6. By moving the spring arm 127 about its lower pivot point 129 inwardly or outwardly relative to the outer end of the upper arm 95 and placing the bolt means 136 in selected holes 175, it can be appreciated that the angular placement of the spring arm 127 and, consequently, the pad bracket 117 and pad 111, can be adjusted inwardly or outwardly from the perpendicular relative to the outer ends of the supporting arms and, consequently, relative to the frame.

Chute means 177, on the order of that disclosed in Pat. No. 3,684,283, is provided in order to control the height at which the practicing players contact the pad units 87. Such chute means includes a padded bar 179 that extends longitudinally of the frame and is operatively disposed above and outwardly of the pad units, as shown in FIG. 2. The bar 179 is supported by arms 181 that extend rearwardly therefrom and are slidably mounted in sleeves 183. The supporting sleeves 183 are provided with descending apertured projections 185 that are attached by pivot pins 187 to upper ends of posts 189 that extending upwardly from the frame member 5, as shown in FIG. 2.

Thus, the blocking chute bar 179 can be moved rectilinearly relative to the frame by sliding the arms 181 or it can be tilted into a completely inoperative position, as shown in dotted lines in FIG. 2, by virtue of the pivotal mounting of the supporting sleeves. Enlarged inner ends 191 on the arms 181 prevent them from being pulled out from the sleeves.

From the foregoing description, taken in conjunction with the accompanying drawings it is believed that the construction, purpose and mode of operation of the instant invention will be clear to those skilled in the art. But, it will be obvious to such skilled in the art that various modifications may be made, and it is intended by the appended claims to cover all such modifications which come within the true spirit and scope of the herein disclosed invention.

What is claimed is:

1. A football lineman trainer comprising a frame mounted on a plurality of elongated ground engaging runners having flat surfaces slidable on the ground, a pad unit disposed vertically in front of each runner, each of said pad units including a substantially rectangular cushioned pad having a substantially flat large outer face adapted to be contacted by the face or shoulder of a lineman, and means attaching each of said pad units on the frame for bodily vertical movement thereof when contacted by a lineman about a pivotal axis transverse to the runner from a lower position to an upper position and from the upper position to the lower position and into and through a position intermediate the lower and upper positions, said attaching means including vertical support means carried by the frame, arm means pivotally mounted on the support means, horizontal pivot pins mounting the arm means on the support means for vertical curvilinear swinging movement, said arm means having an outer end, a pad bracket, means detachably attaching said pad on the pad bracket, and means for so mounting said pad bracket on the outer end of the arm means that the angle of the pad bracket is adjustable relative to said arm means.

2. The trainer of claim 1 wherein said pad bracket is positionable from a straight up position to an approximately 30° leaning position relative to the arm means in any position of the arm means relative to the frame.

3. The trainer of claim 1 wherein means is provided on the arm means for adding weights thereto.

4. The trainer of claim 1 wherein said means securing the pad bracket on the arm means includes means for adjusting the height of the pad relative to the arm means.

5. The trainer of claim 1 wherein said means for securing the pad bracket on the arm means includes a spring bar to which the pad bracket is attached, said spring bar being vertically disposed and having a lower end pivotally attached to the outer end of the arm means and a resilient bumper interposed between the pivot point and the outer end of the arm means with the spring bar and the bumper absorbing the impact of a lineman upon the pad.

6. The trainer of claim 5 wherein said pad bracket is a flat plate and has an outer face over which the pad fits with the pad having straps engaging around the bracket plate and constituting the means for attaching the pad thereon.

7. A football lineman trainer comprising a frame mounted on a plurality of elongated ground engaging runners having flat surfaces slidable on the ground, a pad unit disposed vertically in front of each runner, each of said pad units including a substantially rectangular cushioned pad having a substantially flat large outer face adapted to be contacted by the face or shoulder of a lineman, and means attaching each of said pad units on the frame for bodily vertical movement thereof when contacted by a lineman about a pivotal axis transverse to the runner from a lower position to an upper position and from the upper position to the lower position and into and through a position intermediate the lower and upper positions, means carried by the frame for controlling the degree of ground resistance of the runners, means carried by the frame for moving the pad units into and through said positions, and means operable by an operator positioned on the frame for independently actuating each of said foregoing means.

8. The trainer of claim 7 wherein said means provided on the frame for controlling the degree of ground resistance of the runners includes rollers disposed transversely between said runners and being bodily movable vertically relative thereto and to the ground with certain of said rollers being disposed behind the runners so as to prevent the rear ends of the runners from digging into the ground if the front end of the frame is raised off the ground by contact of linemen with the pad units.

9. A training sled comprising a frame, runners arranged transversely of the frame and having front and rear ends and supporting said frame for sliding movement on the ground, rollers carried by the frame for engagement with the ground to vary the engagement of the runners with the ground, an operator's station provided on the frame, means actuatable from said station for controlling the position of the rollers relative to the ground, a plurality of pad units vertically positioned on the front of the frame, each of said pad units being individually freely bodily movable from lower to higher positions when contacted by the face or shoulder of a lineman, and means actuatable from said station for moving all of said pad units simultaneously into and from said lower and higher positions, each of said pad units including an arm supporting means having inner and outer ends, horizontal pivot means attaching said inner end of the arm supporting means to the frame so that said arm supporting means can swing vertically in a curvilinear path relative to the frame, a pad, and means attaching said pad to the outer end of the arm supporting means.

10. The training sled of claim 9 wherein said pad attaching means is vertically adjustable so as to adjust the height of the pad relative to the arm supporting means.

11. The training sled of claim 9 wherein said pad attaching means is angularly adjustable so as to vary the angular placement of the pad relative to the arm supporting means.

12. The training sled of claim 9 wherein certain of said rollers are positioned rearwardly of the rear ends of the runners.

13. The training sled of claim 9 wherein means is provided for locking the pad units in selected height positions relative to the frame so as to prevent movement at such selected positions of the pad units relative to the frame.

14. A training sled comprising a frame, runners arranged transversely of the frame and having front and rear ends supporting said frame for sliding movement on the ground, rollers carried by the frame for engagement with the ground to vary the engagement of the runners with the ground, an operator's station provided on the frame, means actuatable from said station for controlling the position of the rollers relative to the ground, a plurality of pad units vertically positioned on the front of the frame, each of said pad units being individually freely bodily movable from lower to higher positions when contacted by the face or shoulder of a lineman, means actuatable from said station for moving all of said pad units simultaneously into and from said lower and higher positions, a height controlling chute means adjustably carried by the frame and comprising supports upstanding from the frame, sleeve elements pivotally attached to said supports for movement about horizontal axes, a chute bar adapted to be disposed above the pad units and in a horizontal position and having supporting bars slidable in said sleeve elements whereby the chute bar can be moved rectilinearly and curvilinearly relative to the frame to be positioned in varied horizontal positions and to be moved into an inoperative vertical position relative to the pad units.

* * * * *